United States Patent [19]

Holt

[11] 3,977,563

[45] Aug. 31, 1976

[54] CONTAINER-LID INTERLOCK

[75] Inventor: William Gilbert Holt, Raynham, Mass.

[73] Assignee: Hercules Incorporated, Wilmington, Del.

[22] Filed: June 30, 1975

[21] Appl. No.: 591,679

[52] U.S. Cl. ..... 220/306; 220/355

[51] Int. Cl.[2] ..... B65D 39/00; B65D 43/06

[58] Field of Search ..... 220/306, 352, 355, 356, 220/307, 306, 355

[56] References Cited

UNITED STATES PATENTS

| | | | |
|---|---|---|---|
| 3,424,340 | 1/1969 | Rocher | 220/356 X |
| 3,515,306 | 6/1970 | Roper et al. | 220/306 |
| 3,730,382 | 5/1973 | Heisler | 220/355 |
| 3,804,289 | 4/1974 | Churan | 220/306 |

*Primary Examiner*—William Price
*Assistant Examiner*—Steven M. Pollard
*Attorney, Agent, or Firm*—James W. Peterson

[57] ABSTRACT

The invention is a plastic container and resealable plastic lid interlock which provide centering and positive sealing of the lid with respect to the container as well as sufficient structural support to allow the container and lid to be processed on existing filling, labeling, and packaging equipment. The invention provides a double interlock, a prying flange for foolproof container opening, positive line contact sealing insured by the double interlock and a stackproof shear resistant lip.

4 Claims, 3 Drawing Figures

CONTAINER-LID INTERLOCK

BACKGROUND OF THE INVENTION

Containers which are used for packaging paints and other volatile materials must be designed to maintain a substantially air-tight fit between the lid and container portion. The fact that such an air-tight engagement between lid and container is required to obtain a substantially hermetic seal often makes it difficult and inconvenient to remove the lid from the container. In addition, it is highly undesirable to have a lid having a perimeter greater in diameter than the outside of the container in that the lid can catch and be accidentally dislodged when stacking the containers in close quarters. It is highly desirable to provide a container which is substantially identical in dimension to present metal paint can designs to allow the containers to be processed on conventional paint can filling, labeling and packaging equipment. It is also desirable to provide a container that will stack safely. The instant invention provides a container and lid configuration having positive balanced line contact sealing and having a prying flange, the perimeter of which is substantially no larger in diameter than the outside diameter of the container and which is sheltered by the container's reinforcing rings to prevent accidental lid disengagement. The instant invention also provides an inner shear resistant lip which prevents the lid from accidentally being pushed into the container when several containers are stacked one on top of the other. In addition, the instant invention provides a container and lid whose dimensions and configuration are almost identical to a conventional metal one gallon paint can.

OBJECTS OF THE INVENTION

It is a primary object of the instant invention to provide a container for packaging volatile materials, such as paint, wherein an air-tight friction fit is insured between the lid and the container.

It is another object of the instant invention to provide a container-lid interlock which can be easily removed by a prying tool but yet cannot be accidentally dislodged by adjacent containers, obstructions or by the stacking of containers.

It is still another object of the instant invention to provide a lid which is self-centering on a container body to facilitate engagement of the lid and the container body, especially when the lid is handled by a machine during the engagement process.

It is yet another object of the instant invention to provide a lid which may be readily resealed.

It is still another object of the instant invention to provide a container and lid which nest top and bottom for safe and easy stacking.

It is also an object of the instant invention to provide a container that does not have a rim at the top to trap paint or dirt.

It is, in addition, an object of the instant invention to provide a container that is seamless, rust resistant without special coatings, dent resistant and lightweight.

SUMMARY OF THE INVENTION

It is highly desirable to provide a container and resealable lid design for packaging of volatile materials, such as paint, wherein the container and lid provide a positive seal which cannot be accidentally destroyed by contact of the container and lid with obstructions or by stacking of several containers one on top of the other. It is even more desirable to have a container-lid design which is reusable. To accomplish this purpose, the instant invention provides a plastic container-lid configuration having a locking prying flange and inner shear member which provide a double interlock for uniform line contact sealing, said container-lid design having no diameter larger than the outside diameter of the container itself, said container being cylindrical in cross sections so as to be almost identical to conventional metal one gallon paint cans.

DESCRIPTION OF THE PREFERRED EMBODIMENTS

Figure 1:
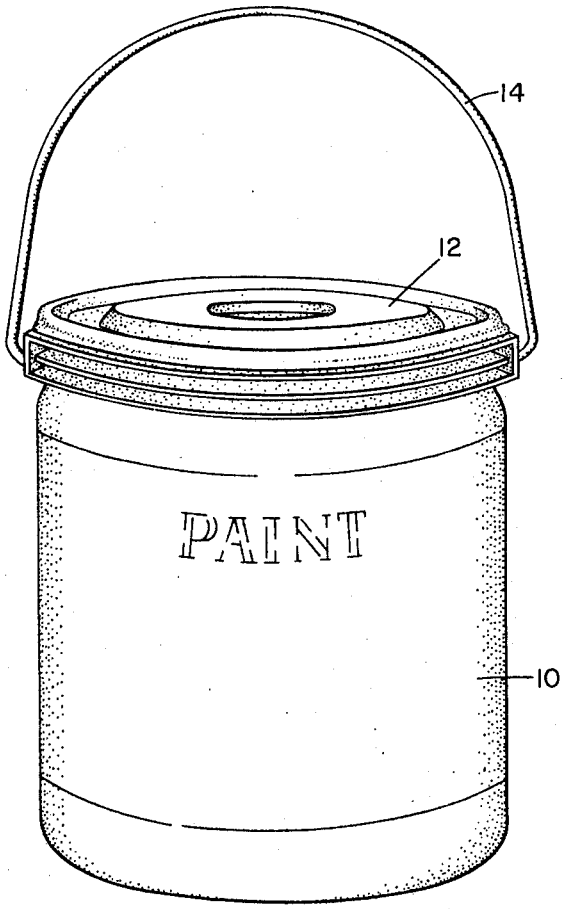
FIG. 1 is a perspective view of the container and lid of the instant invention.

With continued reference to the drawing, FIG. 1 illustrates in perspective view the container 10 and lid 12 of the instant invention. Attached to the container 10 is a metal or plastic bail 14 which facilitates transport of the container 10 with or without lid 12 in place. Polypropylene is the preferred plastic material for the container and lid, but other suitable plastic materials could be used.

Figure 2:
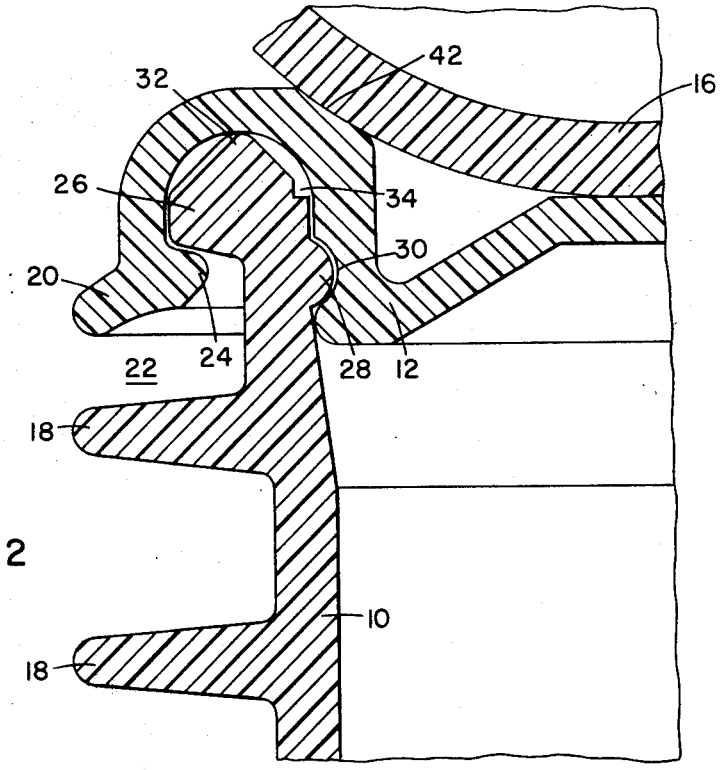
FIG. 2 is a partial cross-sectional view of the container and lid of the instant invention when a second container is in stacking contact.

FIG. 2 illustrates in partial cross-sectional view the container 10 and lid 12 having a second container 16 in stacking contact with lid 12. Container 10 is provided with reinforcing ribs 18 which provide radial strength near the mouth and seal area of the container 10. Reinforcing ribs 18 also provide protection for the locking prying flange 20 of lid 12. Lid 12 is substantially a flat disc having a peripheral channel near the edge of said disc. It can be seen in FIG. 2 that space 22 is provided between prying flange 20 and the topmost reinforcing rib 18 for insertion of a prying instrument such as the blade of a screwdriver (not shown). It can also be seen that the perimeter of the prying flange 20 is no larger in diameter than the outside diameter of the container reinforcing ribs 18 and therefore cannot be accidentally caught on foreign objects. It is, however, within the scope of the instant invention to provide a small tab that would extend beyond prying flange 20 to facilitate removal of the lid. The tab (not shown) would be positioned near one of the bail attachment areas for shelter. The minimal spacing between prying flange 20 and topmost reinforcing rib 18 likewise limits accidental dislodgement by foreign objects thicker than the blade of an average screwdriver. Space 22 is approximately equal to the thickness of prying flange 20. Prying flange 20 is provided with locking portion 24 which is complimentary with projecting rib 26 of container 10. Container 10 is also provided with inwardly projecting shear resistant lip 28 which is complimentary with annular lid detent 30 to provide a double interlock. The double interlock provides a balanced downward holding force of the lid 12 on both the inside and the outside of container 10. This balanced holding force facilitates uniform pressure at line contact seal portion 32 of container 10. Shear resistant lip 28 prevents the lid 12 from disengaging from the container 10 upon prying of flange 20 until a positive lifting motion takes place to release the inside secondary seal at shear resistant lip 28. Shear resistant lip 28 also prevents the lid 12 from being pushed into the container by the force exerted by the stacking of other containers, such as container 16. Container 10 is also provided with a stepped portion 34 to facilitate part removal in container manufacture.

It can also be seen that line contact seal portion 32 provides a camming surface for attachment alignment of lid 12 with respect to container 10.

Shear resistant lip 28 extends inwardly into the container 10 to permit maximum strength in the top wall portion of the container 10. It is important to note that a reversal of parts by placement of a lip on the lid and an annular detent in the container at this point would decrease the wall section of container 10 in a very critical structural area and would therefore be undesirable. The thin wall created by detent 30 in lid 12 is not a structurally weak point but rather serves as a pivot or flexing point for the lid 10 when unlocking prying flange 20 from locking portion 24.

Figure 3:
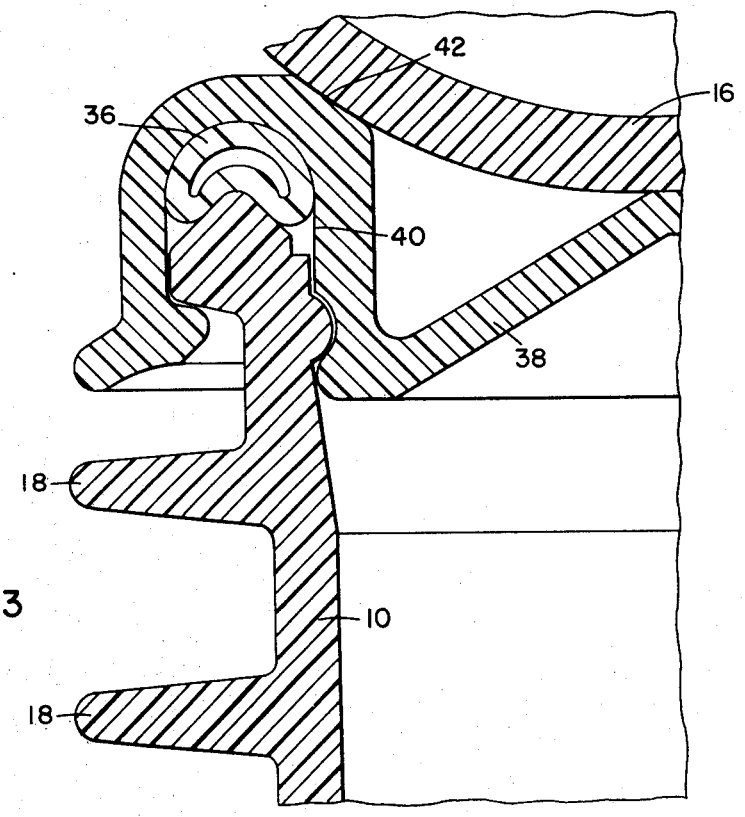
FIG. 3 is a cross-sectional view of an alternate embodiment of the container and the lid of the instant invention having a second container in stacking contact.

FIG. 3 shows an alternate embodiment for special sealing requirements wherein a gasket 36 is first inserted in a lid 38 to seal with container 10. Gasket 36 is shown to be a hollow O-ring, but it is within the scope of the invention to use other solid or hollow resilient gaskets. Lid 38 is essentially identical to lid 12, shown in FIG. 2, with the exception that the channeled portion 40 of lid 38 is made deeper to accommodate gasket 36.

FIGS. 2 and 3 shown an additional container 16 in stacking contact. Lids 12 and 38 are provided with angled sealing portions 42 which cooperate with the bottom of container 16 to facilitate centering alignment of additional stacked containers and helps to distribute the bearing load.

It is understood that the invention is not limited to the precise description given, but that changes are contemplated as readily fall within the spirit of the invention as shall be determined by the scope of the appended claims.

What I claim and desire to protect by Letters Patent is:

1. A resealable plastic container-lid interlock comprising:

a generally cylindrical container having a closed bottom and an open top, said container having a radially outwardly extending locking rib at the top of said container and at least one radially outwardly extending reinforcing rib spaced from the top of said container, said container having an inwardly radially projecting shear resistant lip spaced along the inside of the cylindrical surface below the open top of said container and below said radially outwardly extending locking rib;

a lid for attachment to said container, said lid being substantially a flat disc having a peripheral channel near the edge of said disc; said channel being normal to the plane of said disc, the outer portion of said channel being provided with an inwardly projecting locking portion and an outwardly projecting prying flange, both being substantially in the plane of said disc, said locking portion being complementary with the locking rib of said container and substantially all of the perimeter of said prying flange being no greater in diameter than that of the reinforcing rib of said container so that the prying flange is sheltered from accidental dislodgement, the top of said channel having an angled seating portion directly over the inner portion of said channel to facilitate centering alignment of stacked containers and to distribute a bearing load, the inner portion of said channel having an annular detent in the straight cylindrical wall of said inner portion, said detent being complementary with said shear resistant lip of said container, the cylindrical surface of said container above said shear resistant lip cooperating with the straight cylindrical wall of said inner portion and said angled seating portion to convert stacking and lid impact forces into shear force on said shear resistant lip, said locking portion and said detent providing a double interlock of said lid with respect to said container and providing uniform downward pull on the inner and outer sides of said container to seal said lid with respect to said container.

2. A device as in claim 1 wherein the space between said reinforcing rib and the locking rib of said container defines a space which is greater than the thickness of the prying flange of said lid by an amount approximately equal to the thickness of said prying flange to facilitate prying off of the lid and to shelter the lid from accidental dislocation.

3. A device as in claim 1 wherein an annular gasket means is contained within the channel portion of said lid to supplement sealing of said lid with respect to said container.

4. A device as in claim 2 wherein an annular gasket means is contained within the channel portion of said lid to supplement sealing of said lid with respect to said container.

* * * * *